US005492524A

United States Patent [19]

Marx

[11] Patent Number: 5,492,524

[45] Date of Patent: Feb. 20, 1996

[54] EXERCISE EQUIPMENT

[76] Inventor: Günter W. Marx, Bergstrasse 15, D-88427 Bad Schussenried, Germany

[21] Appl. No.: 313,057

[22] Filed: Sep. 29, 1994

[30] Foreign Application Priority Data

Mar. 30, 1992 [DE] Germany ..... 9204303 U

[51] Int. Cl.[6] ..... A63B 21/008

[52] U.S. Cl. ..... 482/112; 482/129; 482/133; 482/136

[58] Field of Search ..... 482/111, 112, 482/123, 129, 130, 133, 135, 136, 907, 121, 122, 126

[56] References Cited

U.S. PATENT DOCUMENTS 4,943,051 7/1990 Haskins et al. ..... 482/111

FOREIGN PATENT DOCUMENTS 2101891 3/1972 France .
3408036 9/1985 Germany .
87/03499 6/1987 WIPO .

*Primary Examiner*—Lynne A. Reichard
*Attorney, Agent, or Firm*—Smith-Hill and Bedell

[57] ABSTRACT

A device for exercising the user's thigh, back, abdomen, and arm muscles. The device consists of a stand which supports two struts that are arranged in the shape of a "V". Resistance to movement of the struts is provided by a spring element connected to the first and second struts at respective first and second connections points. At least one of the connections points is adjustable along the length of its respective strut.

15 Claims, 2 Drawing Sheets

EXERCISE EQUIPMENT

BACKGROUND OF THE INVENTION

The invention involves exercise equipment, in particular exercise equipment to strengthen muscle groups used in horseback riding.

Although there are many different types of home exercise devices on the market, there is still no exercise equipment that especially targets those muscles used for horseback riding, namely the thighs, back, abdomen and arm muscles. It is possible, of course, to train these muscle groups using existing exercise equipment, but the latter is usually very expensive.

SUMMARY OF THE INVENTION

It is therefore the purpose of the invention to create a piece of training equipment that is strongly and simply-constructed and can be produced cost effectively and makes it possible to strengthen in particular the parts of muscles used when riding a horse.

The exercise equipment consists of a stand which supports two struts that are arranged in the shape of a V. These struts have contact areas for the legs.

The equipment is used by placing the insides of the thigh or knee against the outsides of the struts (facing away from each other) where the contact areas are located. Pressing the legs together pushes the struts towards each other. This is particularly good exercise for the muscular parts of the thigh. Yet these are precisely the muscle groups that are important for sitting correctly on a horse and that enable the rider to use the inside of the legs to guide the horse effectively and purposefully.

In the preferred form of the invention, the space between the contact areas of both sides of the angle can be changed by spring action. By pressing the thighs together, the struts are pushed against each other so that one can see from the deflection how much force is able to be applied using the corresponding thigh muscles. The deflection can also be captured by some suitable means and displayed. As an alternative or in addition to changing the space between the contact areas by pressing both struts together, it may be desirable to display the effective force between the two contact areas. In this case it is not absolutely necessarily that both sides (of the angle) are able to be swung relative to each other. Displaying the application of force can, for instance, be done by a mechanical or piezoelectric force transducer according to known methods.

In the preferred form of the invention, a gas-pressure spring is connected between the struts. The gas-pressure spring's point of application to one or both struts can be adjusted along the length of the corresponding strut, which makes it easy to adjust the zero distance between the contact areas that is, the distance between the contact areas when no force is being applied to the contact areas of the struts. This allows the user to strengthen his or her legs at various relative angles.

The exercise equipment can also be used to train the muscles of the outer thigh, by applying pressure with the knees or thighs between the struts and pressing them apart from each other.

In the preferred form of the invention, both struts are joined at the ends that face each other so that they rotate around a common rotational axis or two rotational axes running parallel to each other.

In the preferred form of the invention, the exercise machine is equipped with a seat close to where the ends of the struts meet. This seat allows the user to mimic the natural sitting position on the horse, especially if the struts beneath the seat run in a general horizontal direction or are tilted slightly downward.

In the preferred form of the invention, the struts are made from round or square tubing that is padded where the thigh rests against them. In another form of the invention, there are handles on the ends of the struts that face away from each other, so that the exercise equipment can be used to strengthen arm and chest muscles. The stand has feet to stabilize it and a post that goes up from the feet, at the top of which is the seat. At the same time, the post forms the common rotational axis for the struts, which are essentially horizontal or slightly downturned. By arranging the seat relative to the struts, seating that is ergonomically correct is ensured, thus preventing any harm to the user's posture.

The distance between the seat and/or struts and the feet can be adjusted, so that the correct sitting position can be set for either tall or short persons.

In the preferred form of the invention, the distance between the struts or the seat and the feet can be set by means of a gas-pressure spring. When the user stands on the feet and grips the struts or seat with the hands, the struts or seat can be pushed downward or pulled upward against the force of the gas-pressure spring. This exercise trains the muscles of the back, chest, arms and abdomen. When the knees are bent, the thigh and lower leg are also exercised. Tractive resistance can also be achieved by means of various types of telescoping dampers.

If the post is equipped with at least two feet, it is beneficial if they have wheels on them so that the exercise equipment can also be used as a walker. In this case the wheels are arranged on the feet so that they do not come in contact with the floor when the exercise equipment is being used under normal conditions. For the former application, the exercise equipment has to be slightly tilted.

BRIEF DESCRIPTION OF THE DRAWINGS

The invention is described below by means of the schematic drawing.

DETAILED DESCRIPTION

Figure 1:
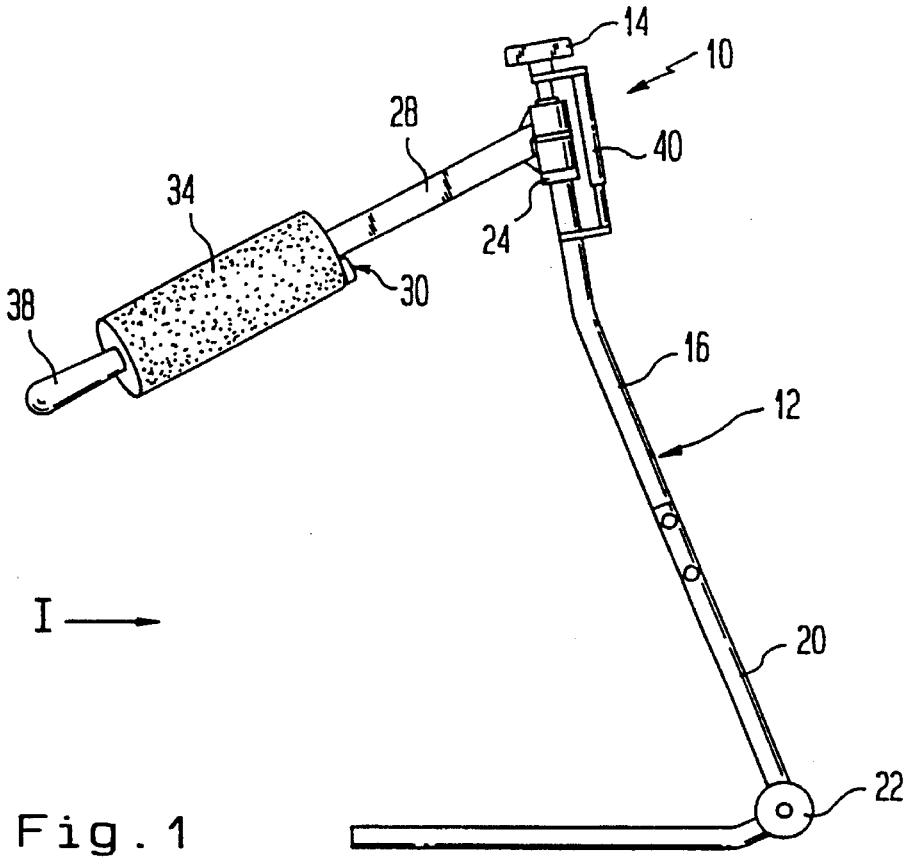
FIG. 1 shows a lateral view of the exercise equipment.
Figure 2:
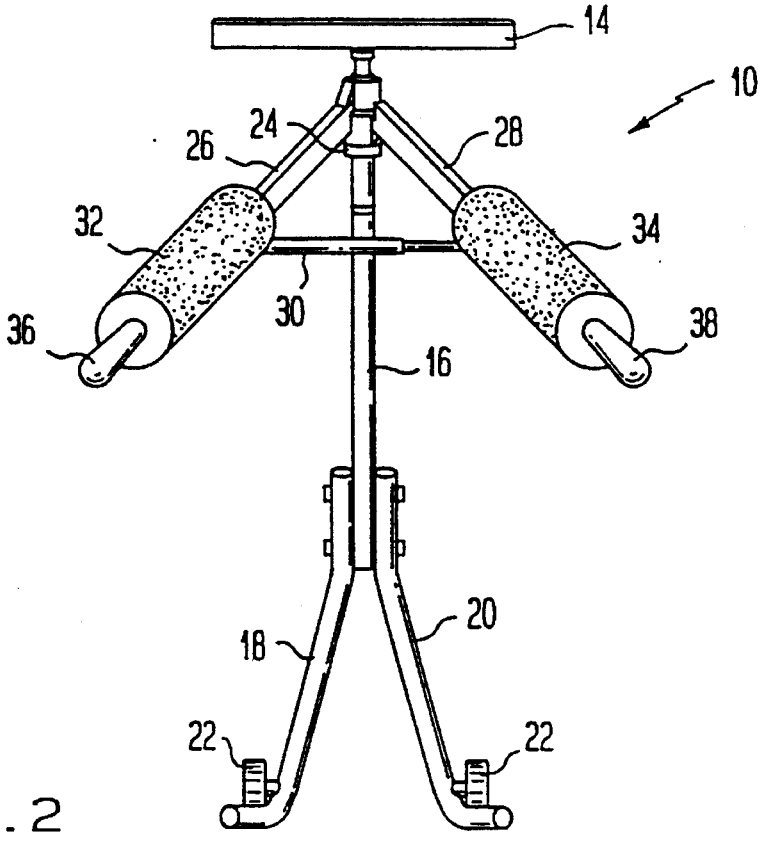
FIG. 2 shows a front view of the exercise equipment in the direction of the arrow I from FIG. 1.

The exercise equipment 10, as depicted in FIGS. 1 and 2, consists of a stand 12, at whose top there is a seat 14.

The stand 12 has a bracing tube 16 in its upper third that runs diagonally up and is angled slightly upwards.

Figure 3:
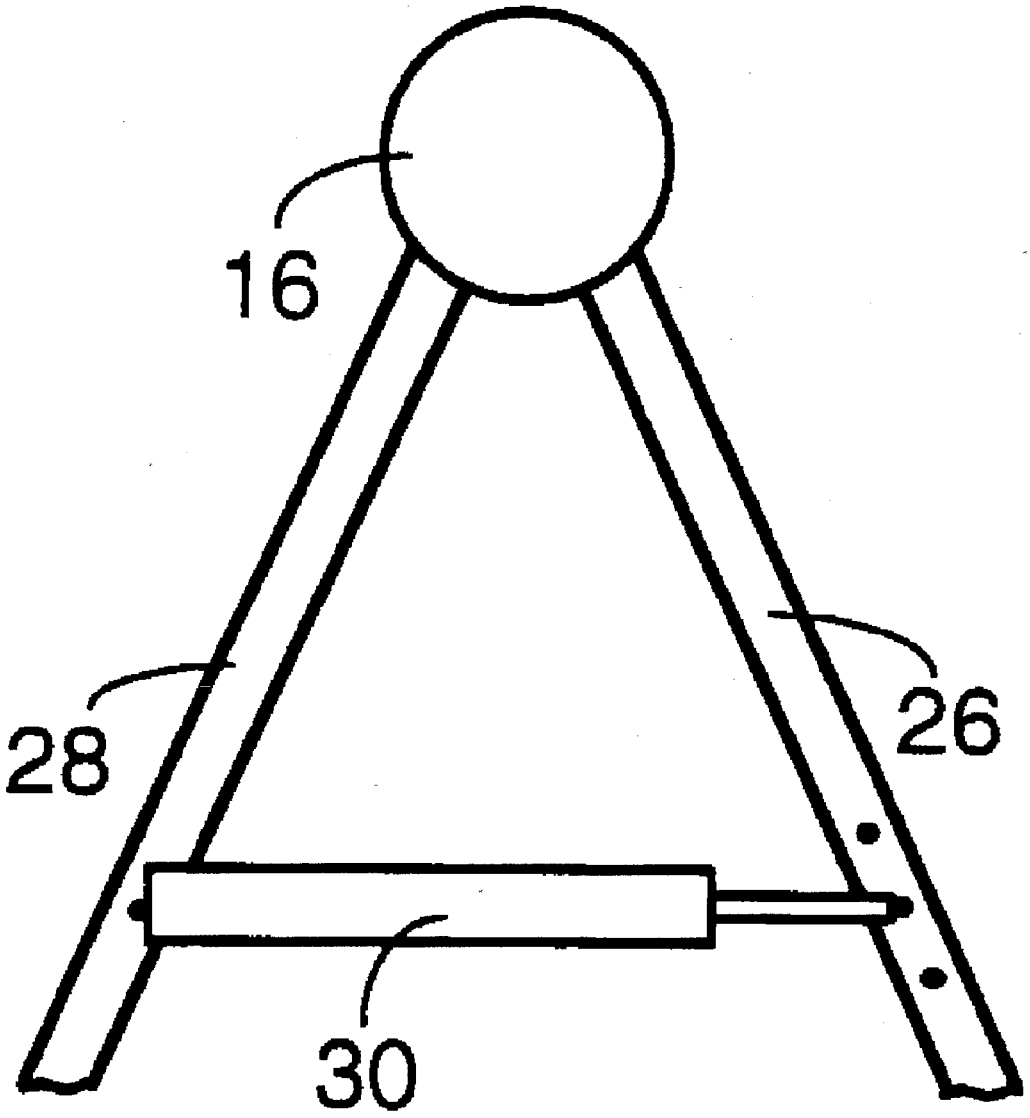
FIG. 3 shows an enlarged view of a part of the exercise equipment.

There are two L-shaped, outspread feet 18, 20 on its lower end. Where the feet bend, there are two running wheels 22 located between the vertical and horizontal sections, by means of which the exercise equipment 10 can be easily moved or used as a walker. The feet 18, 20 are screwed together with the bracing tube 16 in the lower part of the bracing tube 16. In the upper part of the bracing tube 16 there is a collar 24, by means of which two struts 26, 28 rotate around the bracing tube 16 by means of plastic bushings. The struts 26, 28 form the two sides of a V. The enclosed angle between the two struts 26, 28 can be adjusted by means of a gas-pressure spring 30, which is applied to both struts 26, 28. The struts 26, 28 have contact areas 32, 34 in the form of cylindrical padding so that the person seated on the seat 14 can rest his or her thighs or knees against them. There are handles 36, 38 at the outer ends of the struts 26, 28, by means of which the exercise equipment can be used to strengthen chest, arm and back muscles. The height of the seat can be adjusted relative to the bracing tube 16 and the struts 26, 28 by means of a gas-pressure spring or some other similar telescoping device 40. As shown in FIG. 3, the point of attachment of the gas-pressure spring 30 to one of the struts can be adjusted along the length of the strut.

The use of the exercise equipment is explained as follows. As a basic exercise, the person sits on the seat 14 and places the inside of his or her thighs or knees against the outside of the contact areas 32, 34. The position of the seat forces the person to sit in an ergonomically correct posture, thus avoiding back problems. When the thighs are pressed together, both struts 26, 28 swing toward each other against the resistance of the gas-pressure spring 30. This strengthens the muscles of the thigh and significantly improves overall conditioning when used regularly.

Moreover, this exercise also builds and trains the gluteus and abdominal muscles.

In another exercise, the user can stand on the horizontal sections of the feet 18, 22 and pull the seat 14 upward with the hands or push it downward against the resistance of the gas-pressure spring 40. This exercise trains the back, chest, arm and abdominal muscles. If the knees are bent, the thighs and lower legs are also exercised.

In another exercise, in which the user is seated, the exercise equipment is tilted about the free ends of the feet 18, 22. The user holds the handles 36, 38 and presses the struts 26, 28 together or pulls the struts apart against the resistance of the gas-pressure spring 30. This exercise trains the arm, back, chest and abdominal muscles. All the leg muscles are extended without any damaging load on joints and ligaments.

In the same seated position, the user presses his or her feet against the top of the tilted sections of the feet 18, 20 that would normally be on the floor and the seat 14 is gripped from below. The seat is pulled out against the resistance of the gas-pressure spring 40 or pressed in the opposite direction. These movements again train the arm, chest and back muscles. Both of the latter exercises can also be done in a standing or prone position.

The height of the exercise equipment or height of the seat can be adjusted manually by means of the screw joint between part 16 (bracing tube) and the feet (parts 18 and 20). The gas-pressure spring in question can be fastened to the bracing tube 16 on either the inner or outer area.

I claim:

1. Exercise equipment for strengthening various muscle groups, comprising:

a stand having a base portion and a bracing member that extends upward from the base portion, first and second struts each having first and second opposite ends, the struts being attached to the bracing member at their respective first ends in a manner that allows the struts to pivot relative to each other about their respective first ends, the struts diverging at an acute angle from their first ends toward their second ends, and there being contact areas on the struts for applying force to the struts to cause relative pivotal movement of the struts, a spring element connected to the first and second struts at first and second connection points respectively and effective between the two struts for resisting relative pivotal movement of the struts in at least one direction, and wherein at least the first connection point is adjustable lengthwise of the first strut.

2. Exercise equipment according to claim 1, wherein the two struts are pivotable about a common axis.

3. Exercise equipment according to claim 1, wherein the two struts are pivotable about respective parallel axes.

4. Exercise equipment according to claim 1, wherein the spring element urges the struts to an equilibrium position.

5. Exercise equipment according to claim 1, wherein the spring element is a gas-pressure spring.

6. Exercise equipment according to claim 1, comprising first and second handles mounted on the struts at the second ends thereof.

7. Exercise equipment according to claim 1, further comprising a seat attached to the stand.

8. Exercise equipment according to claim 1, wherein the bracing member comprises a post that is inclined to vertical and the struts are inclined downward from horizontal away from the post.

9. Exercise equipment according to claim 1, wherein the bracing member comprises a post that extends upward from the base portion, the struts are disposed to opposite respective sides of a vertical plane containing the post, the base portion comprises feet that are disposed to opposite respective sides of said vertical plane, and the equipment further comprises a seat attached to the post at an upper end thereof and extending transversely of said vertical plane, the feet and seat having areas adapted to be used as contact points for the feet or hands of the user.

10. Exercise equipment according to claim 9, comprising a mechanism effective between the seat and the post for adjusting height of the seat.

11. Exercise equipment according to claim 10, wherein said mechanism comprises a screw connection.

12. Exercise equipment according to claim 10, wherein said mechanism comprises a spring.

13. Exercise equipment according to claim 12, wherein the spring is a gas-pressure spring.

14. Exercise equipment according to claim 1, comprising contact members on the struts at the contact areas thereof.

15. Exercise equipment according to claim 14, wherein the contact members are padded.

* * * * *